US007694507B2

(12) United States Patent
Tokuda

(10) Patent No.: US 7,694,507 B2
(45) Date of Patent: Apr. 13, 2010

(54) CONTROL APPARATUS OF INTERNAL COMBUSTION ENGINE

(75) Inventor: Takeshi Tokuda, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 1182 days.

(21) Appl. No.: 11/280,177

(22) Filed: Nov. 17, 2005

(65) Prior Publication Data

US 2006/0107650 A1 May 25, 2006

(30) Foreign Application Priority Data

Nov. 25, 2004 (JP) ..... 2004-340520

(51) Int. Cl.
*F01N 3/00* (2006.01)

(52) U.S. Cl. ..... 60/284; 60/285; 60/286; 123/295; 123/431

(58) Field of Classification Search ..... 60/234, 60/235, 273, 274, 284–287; 123/429–431, 123/295

See application file for complete search history.

(56) References Cited

U.S. PATENT DOCUMENTS

| | | | | |
|---|---|---|---|---|
| 5,875,743 | A * | 3/1999 | Dickey | 123/25 C |
| 6,314,940 | B1 * | 11/2001 | Frey et al. | 123/431 |
| 6,340,014 | B1 | 1/2002 | Tomita et al. | |
| 6,637,406 | B2 * | 10/2003 | Yamada et al. | 123/431 |
| 6,799,558 | B2 * | 10/2004 | Gmelin et al. | 123/431 |
| 7,150,266 | B2 * | 12/2006 | Nakayama et al. | 123/431 |
| 7,426,918 | B2 * | 9/2008 | Brehob et al. | 123/431 |
| 2004/0149255 | A1 * | 8/2004 | zur Loye et al. | 123/295 |
| 2004/0163379 | A1 * | 8/2004 | Pott et al. | 60/284 |

FOREIGN PATENT DOCUMENTS

| | | | |
|---|---|---|---|
| DE | 100 43 384 | A1 | 3/2002 |
| EP | 0 943 793 | A2 | 9/1999 |
| JP | A 61-250354 | | 11/1986 |
| JP | A-05-280404 | | 10/1993 |
| JP | A-11-303669 | | 11/1999 |
| JP | A-11-324765 | | 11/1999 |
| JP | A 2001-020837 | | 1/2001 |
| JP | A-2002-13431 | | 1/2002 |
| JP | A-2002-89339 | | 3/2002 |

* cited by examiner

*Primary Examiner*—Thomas E Denion
*Assistant Examiner*—Jesse Bogue
(74) *Attorney, Agent, or Firm*—Oliff & Berridge, PLC

(57) ABSTRACT

In an engine including an in-cylinder injector and an intake manifold injector, the fuel injection ratio between the injectors with respect to a total fuel injection quantity in the homogeneous combustion operation is normally set in accordance with the engine operation state (engine speed, load factor). Upon transition from the stratified charge combustion operation to the homogeneous combustion operation, the fuel injection ratio is modified from that of the normal operation during a prescribed control period so that the fuel injection quantity from the intake manifold injector is increased than in the normal operation state, considering that the fuel newly injected via the in-cylinder injector immediately after transition of operation mode is likely to deposit inside the combustion chamber because of the fuel deposited therein during the stratified charge combustion operation. This prevents combustion deterioration in the engine upon transition of the operation mode.

16 Claims, 8 Drawing Sheets

CONTROL APPARATUS OF INTERNAL COMBUSTION ENGINE

This nonprovisional application is based on Japanese Patent Application No. 2004-340520 filed with the Japan Patent Office on Nov. 25, 2004 the entire contents of which are hereby incorporated by reference.

BACKGROUND OF THE INVENTION

1. Field of the Invention

The present invention relates to a control apparatus of an internal combustion engine, and more particularly to fuel injection control at the time of transition from a stratified charge combustion operation to a homogeneous combustion operation in an internal combustion engine provided with first fuel injection means (in-cylinder injector) for injecting fuel into a cylinder and second fuel injection means (intake manifold injector) for injecting fuel into an intake manifold.

2. Description of the Background Art

In an engine having a main fuel injection valve (in-cylinder injector) injecting fuel directly into a combustion chamber of the engine and an auxiliary fuel injection valve (intake manifold injector) injecting fuel into an intake port, fuel injection control switching between an operation in a stratified charge combustion region (hereinafter, also referred to as "stratified charge combustion operation") and an operation in a homogeneous combustion region (hereinafter, also referred to as "homogeneous combustion operation") in accordance with an operation state has been proposed.

Particularly, in a fuel injection control apparatus of an engine disclosed in Japanese Patent Laying-Open No. 2001-020837, a fuel injection ratio of the auxiliary fuel injection valve (intake manifold injector) with respect to a total fuel injection quantity is set to 0 in the stratified charge combustion operation so as to carry out fuel injection only by the main fuel injection valve (in-cylinder injector). This can reduce the capacity of the main fuel injection valve, and the injection speed in the low-load region and hence performance of the stratified charge combustion is improved. In the homogeneous combustion operation, fuel injection is carried out at an appropriate fuel injection ratio between the main fuel injection valve and the auxiliary fuel injection valve, so that performance of the homogeneous combustion in accordance with the operation state can be obtained.

SUMMARY OF THE INVENTION

In the stratified charge combustion operation, fuel injection is carried out primarily via the in-cylinder injector, while in the homogenous combustion operation, both the in-cylinder injector and the intake manifold injector are used to provide a total fuel injection quantity required. Further, at the time of transition of operation mode from the stratified charge combustion operation to the homogenous combustion operation, the set air-fuel ratio is changed from a lean region to a theoretical mixture ratio region.

In the stratified charge combustion operation, in-cylinder injection is carried out during the compression stroke. The fuel is directly sprayed onto the top face of the engine piston (piston top face) and the inner peripheral surface of the cylinder (cylinder inner peripheral surface (bore)), so that the fuel is likely to deposit on the surfaces. This tendency is noticeable particularly in the engine cold state where atomization of the fuel in the cylinder would not be accelerated. The fuel deposition inside the internal combustion engine may lead to generation of black smoke or increase of un-burned components during the subsequent combustion, thereby causing deterioration in exhaust emission performance. Further, lubrication performance of the internal combustion engine may also be degraded due to dilution of lubricating oil due to the fuel.

Further, once the fuel deposition occurs, the fuel injected into the cylinder afterwards will easily deposit on the piston top face and/or the cylinder inner peripheral surface, compared to the case where there is no fuel deposition. Accordingly, if the fuel injection ratio of the in-cylinder injection is large at the time of transition from the stratified charge combustion operation to the homogeneous combustion operation (particularly in the engine cold state), the fuel deposition inside the internal combustion engine may increase as the newly injected fuel will deposit on the piston top face and/or the cylinder inner peripheral surface. As a result, the quantity of the fuel actually burned inside the combustion chamber may be insufficient, in which case the air-fuel ratio in the cylinder (in the combustion chamber) cannot be switched quickly from the lean region to the theoretical mixture ratio region. The homogeneous combustion operation may not be carried out normally, possibly causing deterioration of combustion. Such combustion deterioration may cause deterioration of exhaust emission property, decrease of the engine speed, and other problems.

Conversely, if the fuel injection ratio by the in-cylinder injection is extremely small (nearly zero) at the time of transition from the stratified charge combustion operation to the homogeneous combustion operation (particularly in the engine cold state), although deposition of newly injected fuel may be suppressed, the fuel deposited during the stratified charge combustion operation will be burned, in which case the quantity of the fuel actually burned inside the combustion chamber becomes too much, leading to deterioration of exhaust emission property.

The present invention has been made to solve the above-described problems, and an object of the present invention is to provide a control apparatus of an internal combustion engine having a first fuel injection mechanism for injecting fuel into a cylinder and a second fuel injection mechanism for injecting fuel into an intake manifold, which can appropriately set a fuel injection ratio between the first and second fuel injection mechanisms at the time of transition from a stratified charge combustion operation to a homogeneous combustion operation so as to prevent shortage or excess in quantity of the fuel actually burned in the cylinder, to thereby maintain a normal combustion state of the engine.

A control apparatus of an internal combustion engine according to the present invention is a control apparatus of an internal combustion engine including a first fuel injection mechanism for injecting fuel into a cylinder and a second fuel injection mechanism for injecting fuel into an intake manifold, which includes a fuel injection control portion. The fuel injection control portion performs switching between a homogeneous combustion operation and a stratified charge combustion operation in accordance with an operation state and controls a fuel injection ratio of the first fuel injection mechanism and a fuel injection ratio of the second fuel injection mechanism with respect to a total fuel injection quantity required. Further, the fuel injection control portion includes a first fuel injection ratio setting portion and a second fuel injection ratio setting portion. The first fuel injection ratio setting portion sets the fuel injection ratios based on information correlated with the operation state of the internal combustion engine in the homogeneous combustion operation. The second fuel injection ratio setting portion sets the fuel injection ratios in place of the first fuel injection ratio setting portion during a prescribed period from a switching time point from the stratified charge combustion operation to the homogeneous combustion operation, and increases the fuel injection ratio of the second fuel injection mechanism than the setting by the first fuel injection ratio setting portion with respect to the information of the same content.

In the control apparatus of an internal combustion engine described above, the fuel injection ratio of the first fuel injection mechanism (for in-cylinder injection) and the fuel injection ratio of the second fuel injection mechanism (for intake manifold injection) with respect to a total fuel injection quantity are set such that, at the time of transition of operation mode from the stratified charge combustion operation to the homogeneous combustion operation, the quantity of the fuel injected from the second fuel injection mechanism increases compared to that with the normal fuel injection ratio set in accordance with the operation state of the engine (by the first fuel injection ratio setting portion). In this manner, it is possible to decrease the ratio of the in-cylinder injection that is likely to cause additional fuel deposition immediately after transition of operation mode in the presence of the fuel deposited inside the internal combustion engine (on the piston top face and/or the cylinder inner peripheral surface) during the stratified charge combustion operation. This can avoid shortage in quantity of the fuel actually burned in the combustion chamber. As a result, at the time of transition to the homogeneous combustion operation, the air-fuel ratio can smoothly be changed from the lean region to the theoretical mixture ratio region, ensuring a normal homogeneous combustion operation, and accordingly, engine output property and exhaust emission property are stabilized.

Preferably, in the control apparatus of an internal combustion engine according to the present invention, an increase of the fuel injection ratio of the second fuel injection mechanism by the second fuel injection ratio setting portion is set in accordance with a period (time period, number of times of ignition, or the like) of the stratified charge combustion operation until the switching to the homogeneous combustion operation.

In the control apparatus of an internal combustion engine described above, the increase of the quantity of the fuel injected from the second fuel injection mechanism can be set in association with the stratified charge combustion operation period, or, in association with the quantity of the fuel deposited inside the internal combustion engine due to the in-cylinder injection during the stratified charge combustion operation. Thus, additional fuel deposition upon transition of operation mode to the homogeneous combustion operation, as well as occurrence of problems due to excessive fuel injection into the intake manifold, can be avoided more reliably, and accordingly, deterioration in combustion performance can be prevented more reliably.

Still preferably, in the control apparatus of an internal combustion engine according to the present invention, a length of the prescribed period is set in accordance with a period (time period, number of times of ignition, or the like) of the stratified charge combustion operation until the switching to the homogeneous combustion operation.

In the control apparatus of an internal combustion engine described above, the control period for modifying the fuel injection ratios can be set in accordance with the stratified charge combustion operation period, or, in association with the quantity of the fuel deposited inside the internal combustion engine by the in-cylinder injection during the stratified charge combustion operation. Accordingly, after such control to modify the fuel injection ratios to prevent combustion deterioration becomes unnecessary, the operation can quickly be started with the preferable fuel injection ratios set in accordance with the engine operation state (by the first fuel injection ratio setting portion).

Alternatively, in the control apparatus of an internal combustion engine according to the present invention, an increase of the fuel injection ratio of the second fuel injection mechanism by the second fuel injection ratio setting portion may be set in accordance with an engine speed and a load factor of the internal combustion engine.

In the control apparatus of an internal combustion engine described above, the increase of the quantity of the fuel injected from the second fuel injection mechanism can be set in association with the operation state (engine speed and load factor) of the internal combustion engine upon transition of operation mode to the homogeneous combustion operation. Accordingly, deterioration of combustion performance can be prevented more reliably, as additional fuel deposition upon transition of operation mode to the homogeneous combustion operation as well as occurrence of problems due to excessive fuel injection into the intake manifold are avoided more reliably.

A control apparatus of an internal combustion engine according to another aspect of the present invention is a control apparatus of an internal combustion engine including a first fuel injection mechanism for injecting fuel into a cylinder and a second fuel injection mechanism for injecting fuel into an intake manifold, which includes a fuel injection control portion. The fuel injection control portion performs switching between a homogeneous combustion operation and a stratified charge combustion operation in accordance with an operation state, and controls a fuel injection ratio of the first fuel injection mechanism and a fuel injection ratio of the second fuel injection mechanism with respect to a total fuel injection quantity required. Further, the fuel injection control portion includes a first fuel injection ratio setting portion that sets the fuel injection ratios based on information correlated with the operation state of the internal combustion engine in the homogeneous combustion operation, and a fuel quantity decreasing portion that decreases the total fuel injection quantity by a prescribed quantity during a prescribed period from a switching time point from the stratified charge combustion operation to the homogeneous combustion operation when an operation region of the internal combustion engine at the switching time point falls within a region where the fuel injection ratio of the second fuel injection mechanism is set near 100% by the first fuel injection ratio setting portion.

In the control apparatus of an internal combustion engine described above, at the time of transition from the stratified charge combustion operation to the homogeneous combustion operation, the quantity of the fuel injected from the second fuel injection mechanism (for intake manifold injection) (and thus, the total fuel injection quantity) is decreased, considering that in the engine low-load region where the fuel injection ratios during the homogeneous combustion operation are set such that almost all the fuel is injected from the second fuel injection mechanism (for intake manifold injection), the fuel deposited inside the cylinder during the stratified charge combustion operation would be burned after transition of operation mode. This can prevent combustion failure attributable to excess in quantity of the fuel actually burned in the combustion chamber upon transition of operation mode to the homogeneous combustion operation. Accordingly, engine output property as well as exhaust emission property can be stabilized.

Preferably, in the control apparatus of an internal combustion engine according to the other aspect of the present invention, the fuel injection control portion further includes a second fuel injection ratio setting portion that is used in place of the first fuel injection ratio setting portion during the prescribed period from the switching time point from the stratified charge combustion operation to the homogeneous combustion operation when the operation region of the internal combustion engine at the switching time point falls within a region where the fuel injection ratio of the first fuel injection mechanism is set to a prescribed second reference value or higher by the first fuel injection ratio setting portion. The second fuel injection ratio setting portion increases the fuel injection ratio of the second fuel injection mechanism than the setting by the first fuel injection ratio setting portion with respect to the information of the same content.

In the control apparatus of an internal combustion engine described above, further, in the engine operation region where the fuel injection ratio of the first fuel injection mechanism (for in-cylinder injection) is relatively high, it is configured such that the quantity of the fuel injected from the second fuel injection mechanism increases compared to the quantity with the normal fuel injection ratio set in accordance with the engine operation state (by the first fuel injection ratio setting portion). In this manner, it is possible to decrease the ratio of the in-cylinder injection that is likely to cause additional fuel deposition immediately after transition of operation mode in the presence of the fuel deposited inside the internal combustion engine (on the piston top face and/or the cylinder inner peripheral surface) during the stratified charge combustion operation. This can avoid shortage in quantity of the fuel actually burned in the combustion chamber. Accordingly, both the combustion deterioration attributable to excess in quantity of the burned fuel, which would occur in the region where the fuel injection ratio of the second fuel injection mechanism (for intake manifold injection) is high, and the combustion deterioration attributable to shortage in quantity of the burned fuel, which would occur in the region where the fuel injection ratio of the first fuel injection mechanism (for in-cylinder injection) is high, can be prevented upon transition of operation mode to the homogeneous combustion operation. This enables a normal combustion state to be maintained in the engine.

Still preferably, in the control apparatus of an internal combustion engine according to the present invention, the stratified charge combustion operation is carried out in a warm-up operation of a catalytic converter receiving exhaust gas from the internal combustion engine.

In the control apparatus of an internal combustion engine described above, the stratified charge combustion operation during which fuel injected into the cylinder is highly likely to deposit inside the internal combustion engine is carried out in the engine cold state. This means that combustion deterioration tends to occur at the time of transition of operation mode to the homogeneous combustion operation. As such, the fuel injection ratio setting control or the total fuel injection quantity decreasing control described above has a significant effect of preventing combustion deterioration.

Further, since the stratified charge combustion operation involves in-cylinder fuel injection in the compression stroke, the temperature of the exhaust gas can be increased by retard of the ignition timing. As a result, the amount of heat transmitted from the exhaust gas to the catalyst per unit volume increases, and thus, the catalyst warm-up can be carried out in a short period of time.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
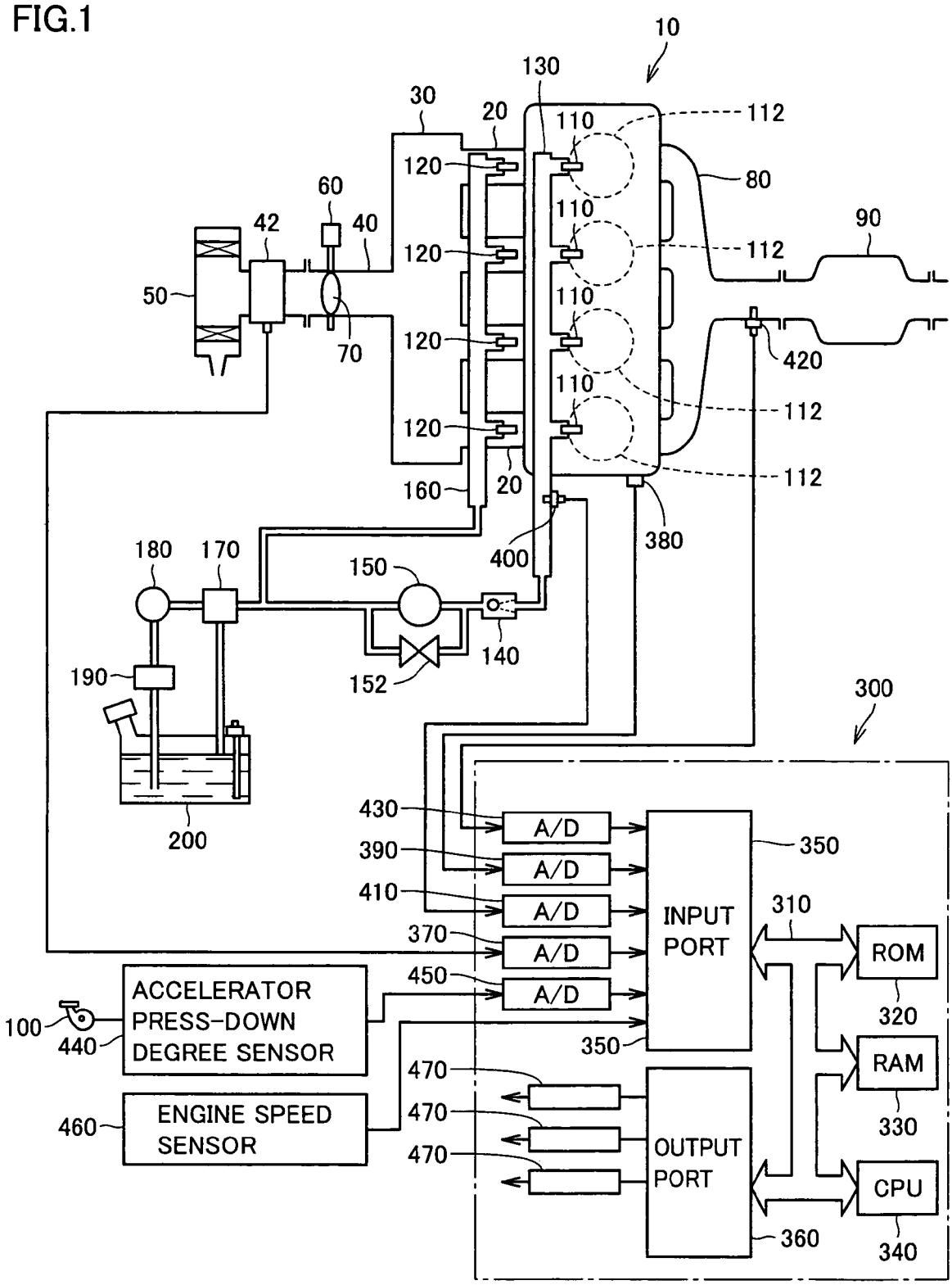
FIG. 1 is a schematic configuration diagram of an engine system controlled by a control apparatus of an internal combustion engine according to an embodiment of the present invention.

Hereinafter, an embodiment of the present invention will be described in detail with reference to the drawings. In the following, the same or corresponding portions in the drawings have the same reference characters allotted, and detailed description thereof will not be repeated where appropriate.

FIG. 1 schematically shows a configuration of an engine system controlled by an engine ECU (Electronic Control Unit) that is a control apparatus of an internal combustion engine according to an embodiment of the present invention. Although an in-line 4-cylinder gasoline engine is shown in FIG. 1, application of the present invention is not restricted to the engine shown.

As shown in FIG. 1, the engine (internal combustion engine) 10 includes four cylinders 112, which are connected via corresponding intake manifolds 20 to a common surge tank 30. Surge tank 30 is connected via an intake duct 40 to an air cleaner 50. In intake duct 40, an airflow meter 42 and a throttle valve 70, which is driven by an electric motor 60, are disposed. Throttle valve 70 has its degree of opening controlled based on an output signal of an engine ECU 300, independently from an accelerator pedal 100. Cylinders 112 are connected to a common exhaust manifold 80, which is in turn connected to a three-way catalytic converter (hereinafter, also simply referred to as "catalytic converter") 90.

For each cylinder 112, an in-cylinder injector 110 for injecting fuel into the cylinder and an intake manifold injector 120 for injecting fuel into an intake port and/or an intake manifold are provided. These injectors 110, 120 are controlled based on output signals of engine ECU 300.

In the present embodiment, description will be made as to the internal combustion engine having two injectors provided separately, although the present invention is not limited thereto. For example, the internal combustion engine may have a single injector capable of performing both in-cylinder injection and intake manifold injection.

As shown in FIG. 1, in-cylinder injectors 110 are connected to a common fuel delivery pipe 130. Fuel delivery pipe 130 is connected to a high-pressure fuel pump 156 of an engine driven type via a check valve 140 that allows flow toward fuel delivery pipe 130. The discharge side of high-pressure fuel pump 150 is connected to the intake side of high-pressure fuel pump 150 via an electromagnetic spill valve 152. It is configured such that the quantity of the fuel supplied from high-pressure fuel pump 150 to fuel delivery pipe 130 increases as the degree of opening of electromagnetic spill valve 152 is smaller, and that fuel supply from high-pressure fuel pump 150 to fuel delivery pipe 130 is stopped when electromagnetic spill valve 152 is fully opened. Electromagnetic spill valve 152 is controlled based on an output signal of engine ECU 300.

Meanwhile, intake manifold injectors 120 are connected to a common fuel delivery pipe 160 on the low-pressure side. Fuel delivery pipe 160 and high-pressure fuel pump 150 are connected to a low-pressure fuel pump 180 of an electric motor driven type via a common fuel pressure regulator 170. Further, low-pressure fuel pump 180 is connected to a fuel tank 200 via a fuel filter 190. Fuel pressure regulator 170 is configured to return a part of the fuel discharged from low-pressure fuel pump 180 to fuel tank 200 when the pressure of the fuel discharged from low-pressure fuel pump 180 becomes higher than a preset fuel pressure. This prevents the pressure of the fuel supplied to intake manifold injectors 120 as well as the pressure of the fuel supplied to high-pressure fuel pump 150 from becoming higher than the preset fuel pressure.

Engine ECU 300 is configured with a digital computer, which includes a ROM (Read Only Memory) 320, a RAM (Random Access Memory) 330, a CPU (Central Processing Unit) 340, an input port 350, and an output port 360, which are connected to each other via a bidirectional bus 310.

Airflow meter 42 generates an output voltage that is proportional to an intake air quantity, and the output voltage of airflow meter 42 is input via an A/D converter 370 to input port 350. A coolant temperature sensor 380 is attached to engine 10, which generates an output voltage proportional to an engine coolant temperature. The output voltage of coolant temperature sensor 380 is input via an A/D converter 390 to input port 350.

A fuel pressure sensor 400 is attached to fuel delivery pipe 130, which generates an output voltage proportional to a fuel pressure in fuel delivery pipe 130. The output voltage of fuel pressure sensor 400 is input via an A/D converter 410 to input port 350. An air-fuel ratio sensor 420 is attached to exhaust manifold 80 located upstream of three-way catalytic converter 90. Air-fuel ratio sensor 420 generates an output voltage proportional to an oxygen concentration in the exhaust gas, and the output voltage of air-fuel ratio sensor 420 is input via an A/D converter 430 to input port 350.

Air-fuel ratio sensor 420 in the engine system of the present embodiment is a full-range air-fuel ratio sensor (linear air-fuel ratio sensor) that generates an output voltage proportional to an air-fuel ratio of the air-fuel mixture burned in engine 10. As air-fuel ratio sensor 420, an $O_2$ sensor may be used which detects, in an on/off manner, whether the air-fuel ratio of the mixture burned in engine 10 is rich or lean with respect to a theoretical air-fuel ratio.

Accelerator pedal 100 is connected to an accelerator press-down degree sensor 440 that generates an output voltage proportional to the degree of press-down of accelerator pedal 100. The output voltage of accelerator press-down degree sensor 440 is input via an A/D converter 450 to input port 350. An engine speed sensor 460 generating an output pulse representing the engine speed is connected to input port 350. ROM 320 of engine ECU 300 prestores, in the form of a map, values of fuel injection quantity that are set corresponding to operation states based on the engine load factor and the engine speed obtained by the above-described accelerator press-down degree sensor 440 and engine speed sensor 460, respectively, and the correction values based on the engine coolant temperature.

Engine ECU 300 generates various control signals for controlling the overall operations of the engine system based on signals from the respective sensors by executing a prescribed program. The control signals are transmitted to the devices and circuits constituting the engine system via output port 360 and drive circuits 470.

In the engine system shown in FIG. 1, two kinds of injectors having such different characteristics are used in accordance with the engine speed and the load factor of engine 10, so that homogeneous combustion is primarily carried out when engine 10 is in a normal operation state.

Meanwhile, when engine 10 is in a catalyst warm-up state at idle, i.e., when it is in an abnormal operation state, stratified charge combustion is carried out. As used herein, the stratified charge combustion includes both the stratified charge combustion and semi-stratified charge combustion. In the semi-stratified charge combustion, intake manifold injector 120 injects fuel in the intake stroke to generate a lean and homogeneous air-fuel mixture in the whole combustion chamber, and then in-cylinder injector 110 injects fuel in the compression stroke to generate a rich air-fuel mixture locally around the spark plug, so as to improve the combustion state. Such semi-stratified charge combustion is preferable in the catalyst warm-up operation for the following reasons. In the catalyst warm-up operation, it is necessary to considerably retard the ignition timing and maintain a favorable combustion state (idle state) so as to cause a high-temperature combustion gas to reach the catalyst. Further, a certain quantity of fuel needs to be supplied. If the stratified charge combustion is employed to satisfy these requirements, the quantity of the fuel will be insufficient. If the homogeneous combustion is employed, the retarded amount for the purpose of maintaining favorable combustion is small compared to the case of stratified charge combustion. For these reasons, the above-described semi-stratified charge combustion is preferably employed in the catalyst warm-up operation, although either of stratified charge combustion and semi-stratified charge combustion may be employed.

In the homogeneous combustion operation, a fuel injection ratio between in-cylinder injector 110 and intake manifold injector 120 with respect to a total fuel injection quantity is controlled basically in the following manner.

Figure 2:
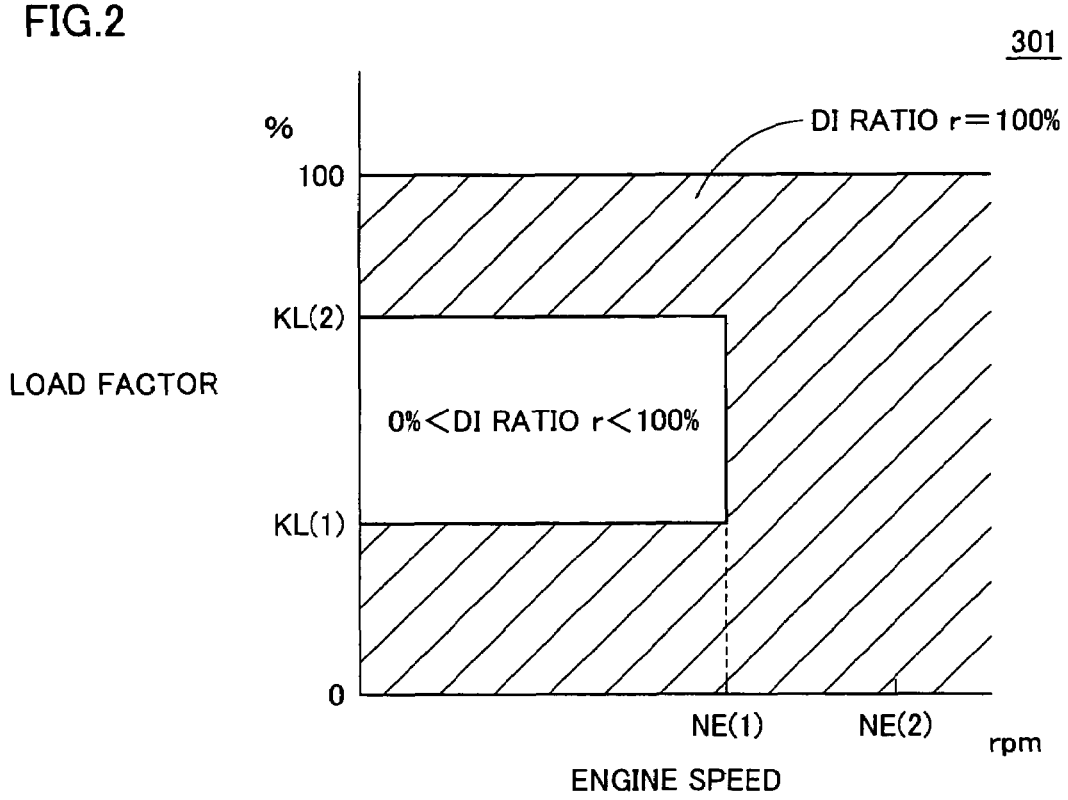
FIGS. 2 and 3 illustrate a first example of DI ratio setting maps in the engine warm state and the engine cold state, respectively, at the time of a homogeneous combustion operation in the engine system shown in FIG. 1.
Figure 3:
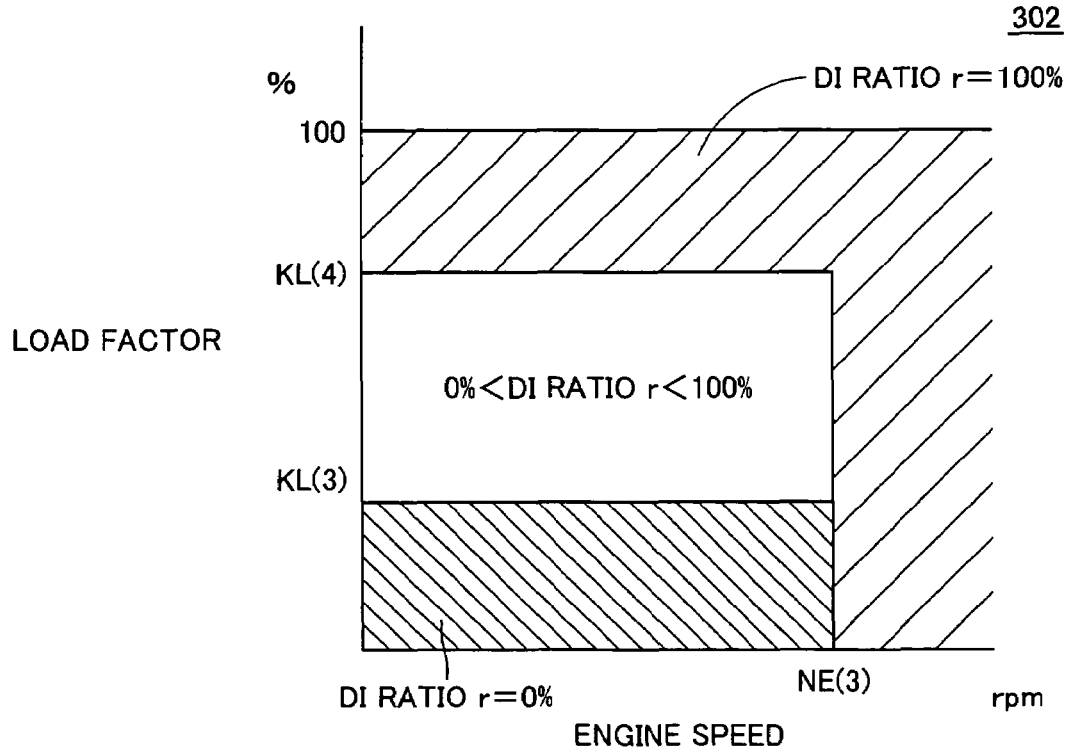

FIGS. 2 and 3 illustrate a first example of setting maps of the fuel injection ratio between in-cylinder injector 110 and intake manifold injector 120 in the homogeneous combustion operation in the engine system shown in FIG. 1.

Referring to FIGS. 2 and 3, the maps each representing a fuel injection ratio between in-cylinder injector 110 and intake manifold injector 120 (hereinafter, also referred to as "DI (Direct Injection) ratio r" representing a ratio of the fuel injected from in-cylinder injector 110 with respect to a total fuel injection quantity), which is identified as information in association with the operation state of engine 10: These maps are stored in ROM 320 of engine ECU 300. The map 301 in FIG. 2 is the map for a warm state of engine 10, and the map 302 in FIG. 3 is the map for a cold state of engine 10.

In these maps 301 and 302, as shown in FIGS. 2 and 3, the fuel injection ratio of in-cylinder injector 110, or DI ratio r, is expressed in percentage, with the horizontal axis representing an engine speed of engine (internal combustion engine) 10 and the vertical axis representing a load factor.

As shown in FIGS. 2 and 3, DI ratio r is defined for each operation region that is determined by the engine speed and the load factor of engine 10. "DI RATIO r=100%" represents the region where fuel injection is carried out using only in-cylinder injector 110, and "DI RATIO r=0%" represents the region where fuel injection is carried out using only intake manifold injector 120. "DI RATIO r≠0%", "DI RATIO r≠100%" and "0%<DI RATIO r<100%" each represent the region where fuel injection is carried out using both in-cylinder injector 110 and intake manifold injector 120.

Generally, in-cylinder injector 110 contributes to an increase of output performance, while intake manifold injector 120 contributes to uniformity of the air-fuel mixture. These two kinds of injectors having different characteristics are appropriately selected depending on the engine speed and the load factor of engine 10, so that primarily homogeneous combustion is conducted in the normal operation state of engine 10.

Further, as shown in FIGS. 2 and 3, the fuel injection ratio between in-cylinder injector 110 and intake manifold injector 120, or, DI ratio r, is defined individually in map 301 for the warm state and in map 302 for the cold state of the engine. The maps are configured to indicate different control regions of in-cylinder injector 110 and intake manifold injector 120 as the temperature of engine 10 changes. When the temperature of engine 10 detected is equal to or higher than a predetermined temperature threshold value, map 301 for the warm state shown in FIG. 2 is selected; otherwise, map 302 for the cold state shown in FIG. 3 is selected. One or both of in-cylinder injector 110 and intake manifold injector 120 are controlled based on the selected map and according to the engine speed and the load factor of engine 10.

The engine speed and the load factor of engine 10 set in FIGS. 2 and 3 will now be described. In FIG. 2, NE(1) is set to 2500 rpm to 2700 rpm, KL(1) is set to 30% to 50%, and KL(2) is set to 60% to 90%. In FIG. 3, NE(3) is set to 2900 rpm to 3100 rpm. That is, NE(1)<NE(3). NE(2) in FIG. 2 as well as KL(3) and KL(4) in FIG. 3 are also set as appropriate.

When comparing FIG. 2 and FIG. 3, NE(3) of map 302 for the cold state shown in FIG. 3 is greater than NE(1) of map 301 for the warm state shown in FIG. 2. This shows that, as the temperature of engine 10 is lower, the control region of intake manifold injector 120 is expanded to include the region of higher engine speed. That is, in the case where engine 10 is cold, deposits are unlikely to accumulate in the injection hole of in-cylinder injector 110 (even if the fuel is not injected from in-cylinder injector 110). Thus, the region where the fuel injection is to be carried out using intake manifold injector 120 can be expanded, to thereby improve homogeneity.

When comparing FIG. 2 and FIG. 3, "DI RATIO r=100%" holds in the region where the engine speed of engine 10 is NE(1) or higher in map 301 for the warm state, and in the region where the engine speed is NE(3) or higher in map 302 for the cold state. In terms of load factor, "DI RATIO r=100%" holds in the region where the load factor is KL(2) or greater in map 301 for the warm state, and in the region where the load factor is KL(4) or greater in map 302 for the cold state. This means that in-cylinder injector 110 alone is used in the region of a predetermined high engine speed, as well as in the region of a predetermined high engine load. That is, in the high speed region or the high load region, even if fuel injection is carried out using only in-cylinder injector 110, the engine speed and the load of engine 10 are high, ensuring a sufficient intake air quantity, so that it is readily possible to obtain a homogeneous air-fuel mixture using in-cylinder injector 110 alone. In this manner, the fuel injected from in-cylinder injector 110 is atomized within the combustion chamber involving latent heat of vaporization (or, absorbing heat from the combustion chamber). Thus, the temperature of the air-fuel mixture is decreased at the compression end, whereby antiknock performance is improved. Further, since the temperature within the combustion chamber is decreased, intake efficiency improves, leading to high power output.

In map 301 for the warm state in FIG. 2, fuel injection is also carried out using only in-cylinder injector 110 when the load factor is KL(1) or less. This shows that in-cylinder injector 110 alone is used in a predetermined low load region when the temperature of engine 10 is high. When engine 10 is in the warm state, deposits are likely to accumulate in the injection hole of in-cylinder injector 110. However, when fuel injection is carried out using in-cylinder injector 110, the temperature of the injection hole can be lowered, whereby accumulation of deposits is prevented. Further, clogging of in-cylinder injector 110 may be prevented while ensuring the minimum fuel injection quantity thereof. Thus, in-cylinder injector 110 alone is used in the relevant region.

When comparing FIG. 2 and FIG. 3, there is a region of "DI RATIO r=0%" only in map 302 for the cold state in FIG. 3. This shows that fuel injection is carried out using only intake manifold injector 120 in a predetermined low load region (KL(3) or less) when the temperature of engine 10 is low. When engine 10 is cold and low in load and the intake air quantity is small, atomization of the fuel is unlikely to occur. In such a region, it is difficult to ensure favorable combustion with the fuel injection from in-cylinder injector 110. Further, particularly in the low-load and low-speed region, high power output using in-cylinder injector 110 is unnecessary. Accordingly, fuel injection is carried out using intake manifold injector 120 alone, rather than using in-cylinder injector 110, in the relevant region.

Further, in an operation other than the normal operation, i.e., in the catalyst warm-up state at idle of engine 10 (abnormal operation state), in-cylinder injector 110 is controlled to carry out stratified charge combustion. By causing the stratified charge combustion during the catalyst warm-up operation, warming up of the catalyst is promoted, and exhaust emission is thus improved.

Figure 4:
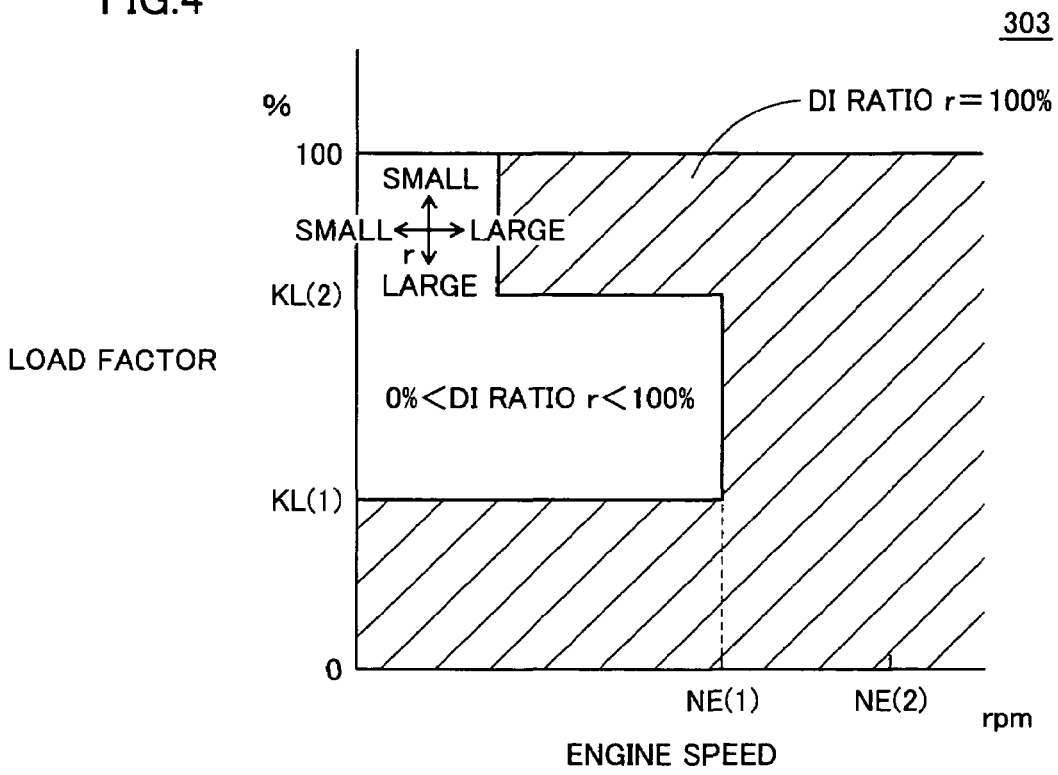
FIGS. 4 and 5 illustrate a second example of the DI ratio setting maps in the engine warm state and the engine cold state, respectively, at the time of the homogeneous combustion operation in the engine system shown in FIG. 1.
Figure 5:
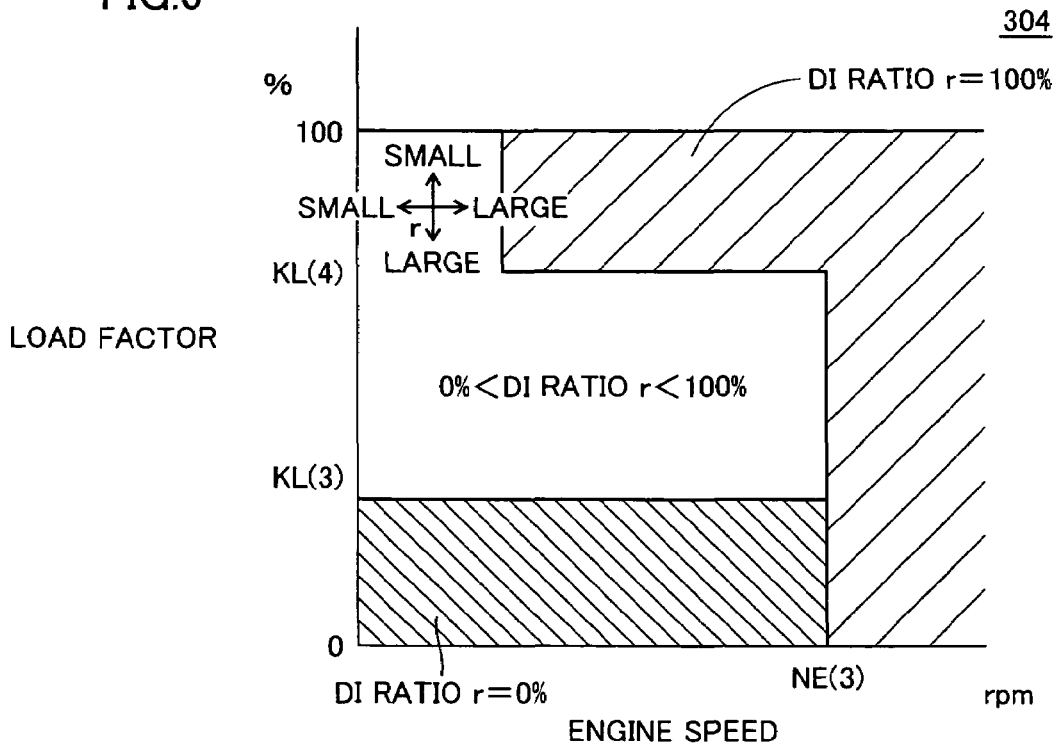

FIGS. 4 and 5 show a second example of the DI ratio r setting maps in the engine system shown in FIG. 1.

The setting maps 303 and 304 shown in FIG. 4 (warm state) and FIG. 5 (cold state) differ from those of FIGS. 2 and 3 in the DI ratio settings in the low-speed and high-load region.

In engine 10, in the low-speed and high-load region, mixing of an air-fuel mixture formed by the fuel injected from in-cylinder injector 10 is poor, and such inhomogeneous air-fuel mixture within the combustion chamber may lead to unstable combustion. Thus, the fuel injection ratio of in-cylinder injector 110 is increased as the engine speed approaches the high-speed region where such a problem is unlikely to occur, whereas the fuel injection ratio of in-cylinder injector 110 is decreased as the engine load approaches the high-load region where such a problem is likely to occur. These changes in DI ratio r are shown by crisscross arrows in FIGS. 4 and 5.

In this manner, variation in output torque of the engine attributable to the unstable combustion can be suppressed. It is noted that these measures are approximately equivalent to the measures to decrease the fuel injection ratio of in-cylinder injector 10 as the state of the engine moves toward the predetermined low speed region, or to increase the fuel injection ratio of in-cylinder injector 110 as the engine state moves toward the predetermined low load region. Further, except for the relevant region (indicated by the crisscross arrows in FIGS. 4 and 5), in the region where fuel injection is carried out using only in-cylinder injector 10 (on the high speed side and on the low load side), a homogeneous air-fuel mixture is readily obtained even when the fuel injection is carried out using only in-cylinder injector 10. In this case, the fuel injected from in-cylinder injector 10 is atomized within the combustion chamber involving latent heat of vaporization (by absorbing heat from the combustion chamber). Accordingly, the temperature of the air-fuel mixture is decreased at the compression end, and thus, the antiknock performance improves. Further, with the temperature of the combustion chamber decreased, intake efficiency improves, which leads to high power output.

DI ratio settings in the other regions in setting maps 303 and 304 of FIGS. 4 and 5 are similar to those in map 301 of FIG. 2 (warm state) and map 302 of FIG. 3 (cold state), and thus, detailed description thereof will not be repeated.

In this engine 10 explained in conjunction with FIGS. 2-5, homogeneous combustion is achieved by setting the fuel injection timing of in-cylinder injector 10 in the intake stroke, while stratified charge combustion is realized by setting it in the compression stroke. That is, when the fuel injection timing of in-cylinder injector 110 is set in the compression stroke, a rich air-fuel mixture can be established locally around the spark plug, so that a lean air-fuel mixture in the combustion chamber as a whole is ignited to realize the stratified charge combustion. Even if the fuel injection timing of in-cylinder injector 110 is set in the intake stroke, stratified charge combustion can be realized if it is possible to provide a rich air-fuel mixture locally around the spark plug.

Further, in engine 10 explained above, the fuel injection timing of in-cylinder injector 110 is set in the intake stroke in a basic region corresponding to the almost entire region (here, the basic region refers to the region other than the region where semi-stratified charge combustion is carried out with fuel injection from intake manifold injector 120 in the intake stroke and fuel injection from in-cylinder injector 110 in the compression stroke, which is carried out only in the catalyst warm-up state). The fuel injection timing of in-cylinder injector 110, however, may be set temporarily in the compression stroke for the purpose of stabilizing combustion, for the following reasons.

When the fuel injection timing of in-cylinder injector 110 is set in the compression stroke, the air-fuel mixture is cooled by the injected fuel while the temperature in the cylinder is relatively high. This improves the cooling effect and, hence, the antiknock performance. Further, when the fuel injection timing of in-cylinder injector 110 is set in the compression stroke, the time from the fuel injection to the ignition is short, which ensures strong penetration of the injected fuel, so that the combustion rate increases. The improvement in antiknock performance and the increase in combustion rate can prevent variation in combustion, and thus, combustion stability is improved.

Hereinafter, transition from the stratified charge combustion operation (catalyst warm-up operation) to the homogeneous combustion operation for normal driving by the control apparatus of an internal combustion engine according to the embodiment of the present invention will be described.

Figure 6:
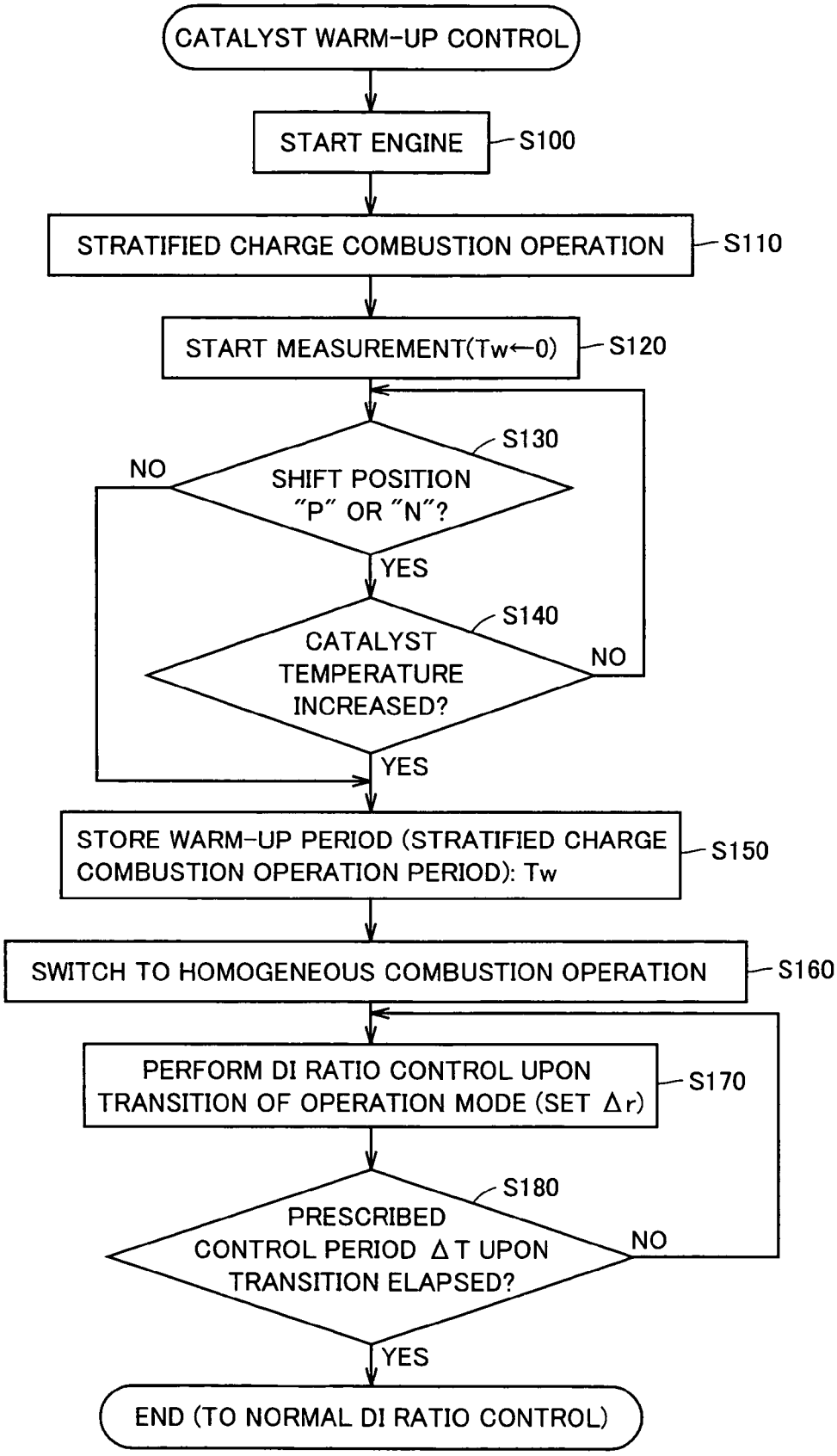
FIG. 6 is a flowchart illustrating an example of catalyst warm-up control according to the control apparatus of an internal combustion engine according to the embodiment of the present invention.

FIG. 6 is a flowchart illustrating the catalyst warm-up control by the control apparatus of an internal combustion engine according to the embodiment of the present invention.

Referring to FIG. 6, when the engine is started (step S100), the stratified charge combustion operation for catalyst warm-up is carried out, wherein fuel is injected from at least one of intake manifold injector 120 and in-cylinder injector 110 according to the air-fuel ratio set in a lean region and also according to a prescribed fuel injection ratio therebetween (step S110). As described above, the stratified charge combustion operation in the present embodiment includes typical stratified charge combustion and the semi-stratified charge combustion described above.

At the start of the stratified charge combustion operation, a timer value Tw is reset to 0 so as to count the warm-up period until the end of the catalyst warm-up operation, i.e., the stratified charge combustion operation period (step S120).

The catalyst warm-up operation is carried out when the shift position selected by means of a shift lever (not shown) is set to P (parking position) or N (neutral position) where the engine rotary shaft and the wheel drive shaft are not coupled to each other.

Thus, during the stratified charge combustion operation, it is periodically determined whether the shift position is either "P" or "N" (step S130).

When a shift position other than "P" or "N" (e.g., D (drive position), R (reverse position) or the like) where the engine rotary shaft and the wheel drive shaft are coupled to each other is selected, the warm-up operation is terminated (NO in step S130).

The stratified charge combustion operation is continued while the shift position is "P" or "N" (YES in step S130), until the catalyst temperature increases (step S140). When the catalyst temperature has increased (YES in step S140), the warm-up operation is terminated.

The determination in step S140 as to whether the catalyst temperature has increased or not can readily be made by integrating the amount of the exhaust gas from engine 10 serving as the heat source for the catalyst warm-up. The temperature of the exhaust gas is predictable since the engine operation condition in the stratified charge combustion operation is almost fixed to a prescribed condition. Thus, the increase in temperature of the catalyst can be determined by calculating the exhaust gas amount based on the intake air amount by airflow meter 42 (FIG. 1), without actually measuring the temperature of catalytic converter 90.

It is noted that the determination concerning the shift position in step S130 in the warm-up operation is not essential. It may be configured such that the stratified charge combustion operation is continued until the catalyst temperature increases, irrespective of the shift position.

At the end of the catalyst warm-up operation, the warm-up period from the time point when counting was started in step S120 to the end of the warm-up operation, i.e., stratified charge combustion operation period Tw, is obtained and stored (step S150). For stratified charge combustion operation period Tw, the execution time of the warm-up operation, the number of times of ignition during the warm-up operation or the like may be employed.

When the warm-up operation is finished, engine 10 switches to the homogeneous combustion operation for a normal operation (step S160).

With the transition to the homogeneous combustion operation, the air-fuel ratio setting is switched from the lean region to the theoretical mixture ratio region, and fuel injection control and intake air amount control, i.e., control of opening degree of throttle valve 76 (FIG. 1), are carried out in engine 10.

The problem of combustion deterioration at this time will now be described with reference to FIG. 7, which corresponds to the cross sectional view of each cylinder 112.

Figure 7:
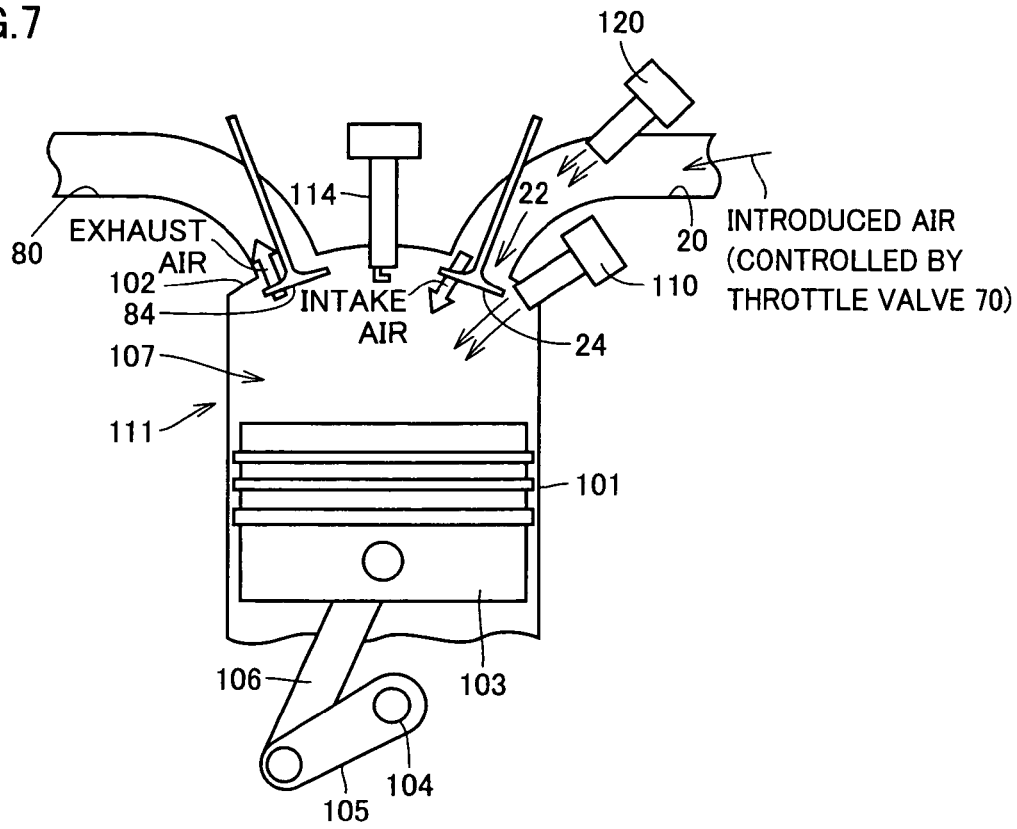
FIG. 7 illustrates a configuration of the engine shown in FIG. 1.

Referring to FIG. 7, each cylinder is configured with a cylinder 111 having a cylinder block 101 and a cylinder head 102 connected to the top of cylinder block 101, and a piston 103 moving in cylinder 111 in a reciprocating manner. Piston 103 is connected to a crankshaft 104 that is an output shaft of engine 10 via a crank arm 105 and a connecting rod 106. Connecting rod 106 converts the reciprocating motion of piston 103 to rotary motion of crankshaft 104. In cylinder 111, a combustion chamber 107 for burning the air-fuel mixture therein is provided, which is delimited by inner walls of cylinder block 101 and cylinder head 102 and the top face of piston 103.

At cylinder head 102, a spark plug 114 for ignition of the air-fuel mixture and in-cylinder injector 110 injecting fuel into combustion chamber 107 are arranged to project into combustion chamber 107. Further, intake manifold injector 120 is arranged to inject fuel into an intake manifold 20 and/or an intake port 22 through which intake manifold 20 communicates with combustion chamber 107.

The air-fuel mixture containing the fuel injected to intake manifold 20 and/or intake port 22 is guided into combustion chamber 170 during the valve-opening period of an intake valve 24. The exhaust gas after burning of the fuel by ignition by spark plug 114 is sent via an exhaust manifold 80 to catalytic converter 90 during the valve-opening period of an exhaust valve 84.

In the stratified charge combustion operation, the fuel is sprayed directly onto the top face of piston 103 (piston top face) and/or the inner peripheral surface within cylinder 111 (cylinder inner peripheral surface) from in-cylinder injector 110 during the compression stroke, and thus, the fuel tends to deposit on these sites. Particularly, in the present embodiment, the stratified charge combustion operation is conducted at the time of catalyst warm-up, i.e., in the engine cold state, so that such deposition of the fuel is likely to occur.

Once the fuel is deposited on the inner wall of the combustion chamber (piston top face and/or cylinder inner peripheral surface), compared to the state where there is no such fuel deposition, the fuel injected from in-cylinder injector 110 afterwards is more likely to deposit on the inner wall of the combustion chamber. Thus, at the time of transition from the stratified charge combustion operation to the homogeneous combustion operation, it is highly possible that the fuel directly sprayed onto the piston top face and/or the cylinder inner peripheral surface from in-cylinder injector 110 will deposit thereon.

The fuel of the quantity required for the homogeneous combustion operation is injected using both in-cylinder injector 110 and intake manifold injector 120 according to a DI ratio, as described above. Thus, when the fuel injected from in-cylinder injector 110 is deposited inside the combustion chamber and is not burned in the relevant cycle, the quantity of the fuel actually burned in combustion chamber 107 becomes insufficient, in which case the air-fuel ratio cannot be switched quickly from the lean region to the theoretical mixture ratio region. As a result, a normal homogeneous combustion operation cannot be carried out, which may lead to deterioration of combustion, deterioration of exhaust emission property, decrease of engine speed, and others.

By comparison, the fuel injected from intake manifold injector 120 is sufficiently mixed with the air before being flown into the combustion chamber (into the cylinder), and thus, it is unlikely to deposit inside the combustion chamber. Thus, at the time of transition to the homogeneous combustion operation, under the condition that the total fuel injection quantity from in-cylinder injector 110 and intake manifold injector 120 is the same, it is preferable to increase the quantity of the fuel injected from intake manifold injector 120 for the purpose of preventing combustion deterioration in the engine in association with the transition of the operation mode.

As described above in conjunction with FIGS. 2-5, the DI ratio at the time of the homogeneous combustion operation is determined basically according to the engine operation region (particularly, engine speed and load factor). In contrast, in the control apparatus of an internal combustion engine of the embodiment of the present invention, the fuel injection ratio of intake manifold injector 120 with respect to the total fuel injection quantity is increased from the normal level, i.e., the DI ratio is decreased from the normal level, during the period immediately after the transition to the homogeneous combustion operation.

Referring again to FIG. 6, upon transition to the homogeneous combustion operation, from the standpoint of preventing new fuel deposition inside combustion chamber 107, DI ratio control upon transition of operation mode is carried out in place of the normal DI ratio setting control shown in FIGS. 2-5. Further, a control period ΔT for conducting such DI ratio control is set (step S170).

Specifically, the DI ratio setting in the normal operation by engine ECU 300 in accordance with maps 301-304 shown in FIGS. 2-5 corresponds to the "first fuel injection ratio setting means" of the present invention, and the DI ratio setting in step S170 corresponds to the "second fuel injection ratio setting means" of the present invention.

Figure 8:
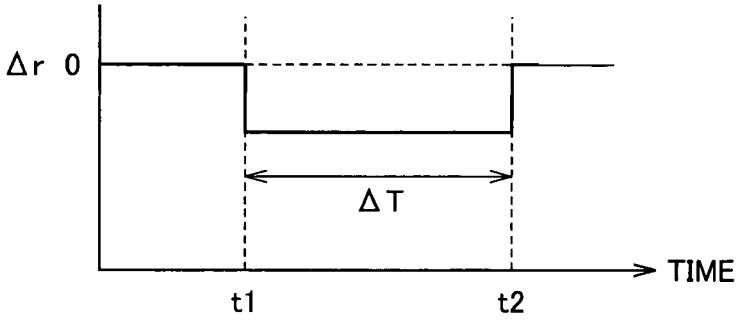
FIG. 8 is a conceptual diagram illustrating the DI ratio control at the time of transition to the homogeneous combustion operation.

As shown in FIG. 8, during the control period ΔT (from time t1 to time t2, or the period until a prescribed number of times of ignition is counted) starting at time t1 corresponding to the time point of transition from the stratified charge combustion operation to the homogeneous combustion operation, the DI ratio is decreased by a correction amount $|\Delta r|$. That is, the DI ratio is set to "$r+\Delta r$" ($\Delta r<0$) compared to the basic DI ratio r that is set in accordance with the operation conditions of engine 10 by referring to the maps shown in FIGS. 2-5.

It is expected that as the stratified charge combustion operation period is longer, the quantity of the fuel deposited inside the combustion chamber at the end of the stratified charge combustion operation will be greater. This means that there is a higher risk the fuel injected from in-cylinder injector 110 will deposit inside the combustion chamber after transition to the homogeneous combustion operation when the warm-up period (stratified charge combustion operation period) Tw is longer. Thus, it is necessary to elongate control period ΔT and to increase the absolute value of DI ratio correction amount Δr.

Figure 9:
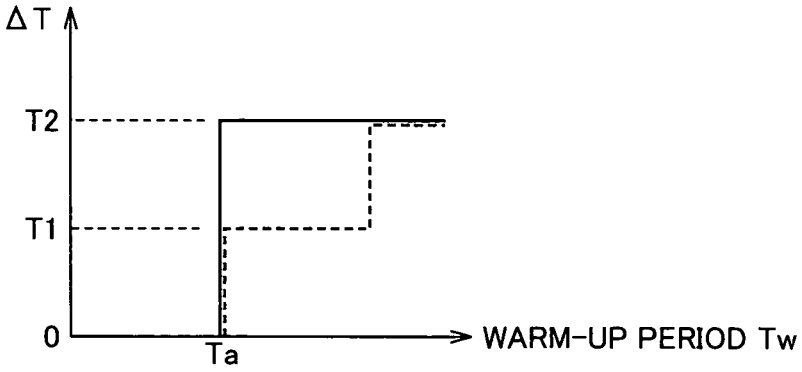
FIG. 9 is a conceptual diagram illustrating setting of a DI ratio control period at the time of transition to the homogeneous combustion operation.

As shown in FIG. 9, control period ΔT is set in accordance with the warm-up period (stratified charge combustion operation period) Tw obtained in step S150. Control period ΔT may be indicated with the lapsed time, the number of times of ignition, or the like.

When warm-up period Tw is shorter than a threshold value Ta and the expected quantity of the fuel deposited inside the combustion chamber is not so large, there is a low risk that the fuel injected from in-cylinder injector 110 after transition to the homogeneous combustion operation is deposited inside the combustion chamber. Thus, it is highly possible that the homogeneous combustion operation can be conducted normally without the need of lowering the DI ratio. As such, control period ΔT is set to 0, and the normal DI ratio setting based on the maps shown in FIGS. 2-5 is carried out from the time point of transition to the homogeneous combustion operation.

Meanwhile, when warm-up period Tw is longer than threshold value Ta, a prescribed control period ΔT is set in accordance with warm-up period Tw. Alternatively, control period ΔT may be selected from among a plurality of steps (T1, T2 in FIG. 9) in accordance with warm-up period Tw as shown by a broken line in FIG. 9, or it may be set continuously in accordance with warm-up period Tw, such that control period ΔT is set longer as warm-up period Tw is longer.

Figure 10:
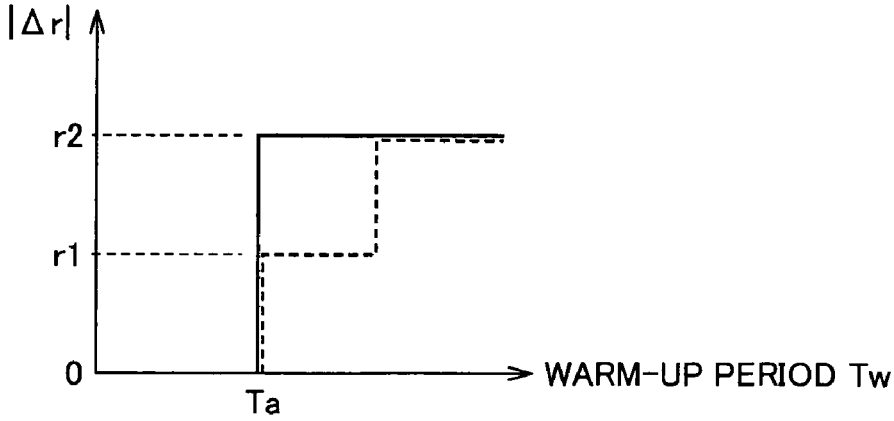
FIGS. 10 and 11 are conceptual diagrams illustrating setting of a DI ratio correction amount at the time of transition to the homogeneous combustion operation.

Similarly, DI ratio correction amount Δr may be set in accordance with warm-up period Tw, as shown in FIG. 10.

Referring to FIG. 10, while |Δr| is set to 0 when warm-up period Tw is shorter than threshold value Ta as described above, DI ratio correction amount Δr is set in accordance with warm-up period Tw when warm-up period Tw is longer than threshold value Ta.

Specifically, in order to make the absolute value of DI ratio correction amount Δr greater as warm-up period Tw is longer, |Δr| may be selected from among a plurality of steps (r1, r2 in FIG. 10) in accordance with warm-up period Tw as shown by a broken line in FIG. 10, or it may be set continuously in accordance with warm-up period Tw.

Figure 11:
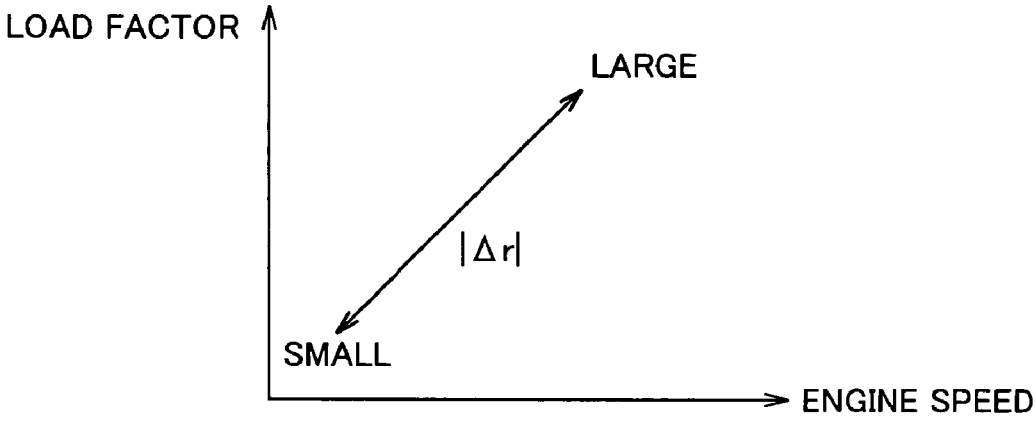

Further, as shown in FIG. 11, DI ratio correction amount Δr may be determined according to the engine operation conditions (engine speed and load factor). More specifically, DI ratio correction amount Δr may be set such that its absolute value becomes greater in the engine high-speed and high-load region and smaller in the engine low-speed and low-load region.

In the high-speed and high-load region, the total fuel injection quantity is large. Thus, it is necessary to suppress the quantity of the fuel injected from in-cylinder injector 110 by increasing DI ratio correction amount |Δr| to further decrease the DI ratio.

Referring again to FIG. 6, a time lapse of control period ΔT set in step S170 is monitored (step S180), and during control period ΔT, the DI ratio is decreased by |Δr| compared to normal DI ratio r.

After a lapse of control period ΔT (YES in step S180), the catalyst warm-up control is terminated, and the normal DI ratio setting control according to the maps in FIGS. 2-5 is carried out.

Although not shown in FIG. 6, in response to engine start (step S100), it is firstly determined whether the catalyst warm-up operation is necessary or not based on the engine coolant temperature or the like. That is, at the time of engine start, if the engine coolant temperature is a prescribed reference temperature or higher, the catalyst warm-up operation control is terminated at that stage, and the homogeneous combustion operation according to the DI ratio maps shown in FIGS. 2-5 is carried out.

As described above, in the control apparatus of an internal combustion engine according to the embodiment of the present invention, at the time of transition from the stratified charge combustion operation to the homogeneous combustion operation, the DI ratio is lowered from the normal DI ratio (FIGS. 2-5) set in accordance with the engine operation conditions. In this manner, it is possible to decrease the ratio of the fuel injected from in-cylinder injector 110 that would cause additional fuel deposition immediately after transition of operation mode in the presence of the fuel deposited during the stratified charge combustion operation. This can avoid insufficient fuel combustion within the combustion chamber. As a result, at the time of transition to the homogeneous combustion operation, the air-fuel ratio can smoothly be changed from the lean region to the theoretical mixture ratio region, ensuring a normal homogeneous combustion operation, and accordingly, engine output property and exhaust emission property are stabilized.

Further, by setting DI ratio correction amount Δr and control period ΔT in accordance with warm-up period (stratified charge combustion operation period) Tw, the fuel injection ratio of intake manifold injector 120 can be increased in association with the quantity of the fuel deposited inside the combustion chamber during the stratified charge combustion operation. This more reliably prevents deterioration in combustion efficiency at the time of transition to the homogeneous combustion operation. Further, after the combustion deterioration is avoided, it is possible to quickly start the operation with the preferable DI ratio setting for the normal operation (DI ratio r in accordance with the maps in FIGS. 2-5).

Other Example of Catalyst Warm-Up Operation Control

The catalyst warm-up control according to the flowchart shown in FIG. 6 can prevent combustion deterioration attributable to shortage in quantity of the fuel actually burned in the combustion chamber at the time of transition from the stratified charge combustion operation to the homogeneous combustion operation. Such fuel shortage is expected in the region where the DI ratio is relatively high, as understood from the above explanation.

Meanwhile, there is a region where the DI ratio is set to 0% immediately after transition to the homogeneous combustion operation, as seen from FIGS. 3 and 5. As described above, the fuel injected from intake manifold injector 120 is sufficiently mixed with the air before being flown into the combustion chamber (into the cylinder). In this region, although new fuel deposition inside the combustion chamber after transition to the homogeneous combustion operation is unlikely to occur, an excessive quantity of the fuel may actually be burned within the combustion chamber due to burning of the fuel deposited during the stratified charge combustion operation, which may deteriorate exhaust emission property. Hereinafter, a control manner for also preventing combustion deterioration in the region of DI ratio≈0% upon transition of operation mode will be described.

Figure 12:
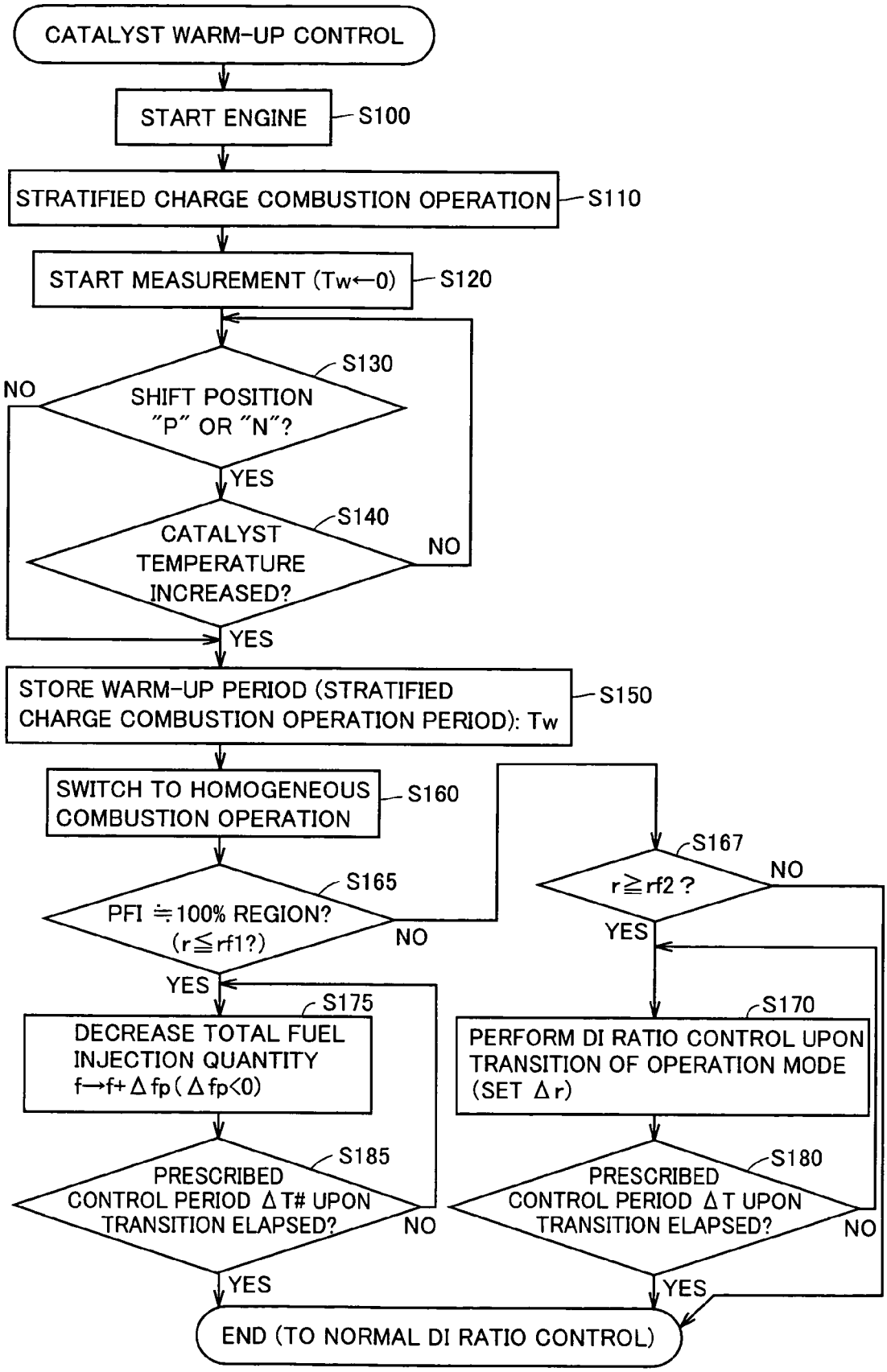
FIG. 12 is a flowchart illustrating another example of the catalyst warm-up control by the control apparatus of an internal combustion engine according to the embodiment of the present invention.

FIG. 12 is a flowchart illustrating the other example of the catalyst warm-up control by the control apparatus of an internal combustion engine according to the embodiment of the present invention.

Referring to FIG. 12, steps S100-S160 are identical to those in the flowchart shown in FIG. 6, and thus, detailed description thereof will not be repeated.

In the catalyst warm-up control shown in FIG. 12, at the time of transition to the homogeneous combustion operation, it is firstly determined whether the engine operation conditions at that time correspond to the region where normal DI ratio r is approximately 0% (where almost all the fuel is injected from intake manifold injector 120) by referring to the basic DI ratio maps in FIGS. 2-5 (step S165). More specifically, it is determined whether the engine operation conditions at the time point of transition to the homogeneous combustion operation fall within the region where the normal DI ratio set in accordance with the maps in FIGS. 2-5 is not greater than a first reference value rf1. That is, first reference value rf1 is a prescribed value near 0%.

Figure 13:
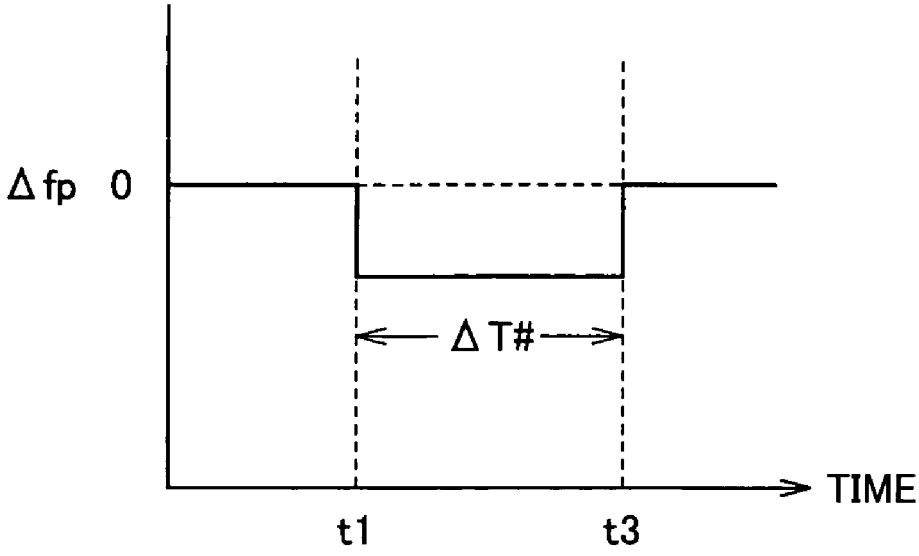
FIG. 13 is a conceptual diagram illustrating fuel injection quantity control in the catalyst warm-up control shown in FIG. 12.

When the engine operation conditions at the time of transition of operation mode correspond to the region of DI ratio≈0% (YES in step S165), the total fuel injection quantity is decreased from the original total fuel injection quantity by a fuel injection decrease quantity Δfp during a control period ΔT#, as shown in FIG. 13. That is, during control period ΔT#, the total fuel injection quantity is set to "f+Δfp" (Δfp<0) with respect to the original total fuel injection quantity f.

The control of decreasing the fuel injection quantity in step S175 is carried out during control period ΔT# (from time t1 to time t3, or until the prescribed number of times of ignition is counted) (step S185). After a lapse of control period ΔT#, the catalyst warm-up control is terminated, and the normal DI ratio setting control according to the maps in FIGS. 2-5 is carried out.

Control period ΔT# may be set equal to control period ΔT of the DI ratio control, or it may be set to a separate value. Further, fuel injection decrease quantity Δfp may be set in accordance with warm-up period (stratified charge combustion operation period) Tw or in accordance with the engine operation conditions (engine speed and load factor), as in the case of DI ratio correction amount Δr.

As such, at the time of transition from the stratified charge combustion operation to the homogeneous combustion operation, in the engine low-load region where the DI ratio in the homogeneous combustion operation is set nearly equal to 0%, the total fuel injection quantity is decreased taking account of the fuel deposited inside the cylinder during the stratified charge combustion operation. Accordingly, it is possible to prevent combustion deterioration attributable to excess in quantity of the fuel actually burned.

Meanwhile, when the engine operation conditions upon transition of operation mode are out of the region where DI ratio≈0% (NO in step S165), it is further determined whether the relevant engine operation conditions correspond to the region where normal DI ratio r becomes a second reference value rf2 or greater by referring to the basic DI ratio maps in FIGS. 2-5 (step S167). Second reference value rf2 is set equal to or greater than first reference value rf1 corresponding to the region where combustion deterioration may occur because the fuel injection ratio of intake manifold injector 120 is low (i.e., the DI ratio is high).

As described above, first reference value rf1 and second reference value rf2 may be set in accordance with the design of engine 10, by experimentally obtaining the boundary region where combustion deterioration attributable to the fuel deposited during the stratified charge combustion operation becomes a problem.

In the region where normal DI ratio r is second reference value rf2 or higher (YES in step S167), steps S170 and S180 identical to those in FIG. 6 are carried out. The DI ratio is lowered by |Δr| during control period ΔT to thereby prevent deterioration of combustion.

Further, in the region where normal DI ratio r is smaller than second reference value rf2 (NO in step S167), the catalyst warm-up control is terminated without performing DI ratio correction, and the vehicle operation is carried out with the normal total fuel injection quantity and in accordance with the normal DI ratio control according to the maps in FIGS. 2-5, immediately after the transition of operation mode.

As described above, in the catalyst warm-up control according to the flowchart shown in FIG. 12, at the time of transition from the stratified charge combustion operation to the homogeneous combustion operation, it is possible to prevent combustion deterioration attributable to excess in quantity of the burned fuel because of burning of the fuel deposited during the stratified charge combustion operation, which would occur in the region where the DI ratio is too low upon transition of operation mode, and also to prevent combustion deterioration attributable to shortage in quantity of the burned fuel because of additional fuel deposition, which would occur in the region where the DI ratio is high. This enables a normal combustion state to be maintained in the engine.

In the warm-up operation control according to the present embodiment, the DI ratio control upon transition of operation mode is carried out with the configuration where the arithmetic operation for DI ratio correction (r+Δr) is performed in step S170 in FIG. 6 or 12. Alternatively, a map for use upon transition of operation mode having correction amount Δr added therein in advance may be prepared separately, in which case in step S170, the DI ratio may be determined by referring to the relevant map for use upon transition of operation mode, instead of the basic DI ratio setting maps (basic maps) in FIGS. 2-5. This configuration is more preferable from the standpoint of decreased operation load of engine ECU 300.

In this case, in step S170, it is further determined whether warm-up period Tw is shorter than threshold value Ta shown in FIGS. 9 and 10. If warm-up period Tw exceeds threshold value Ta, the above-described map for use upon transition of operation mode is referred to. Particularly in the case where a plurality of steps of DI ratio correction amount |Δr| are set in accordance with warm-up period Tw as shown in FIG. 10, it is necessary to prepare a plurality of maps for use upon transition of operation mode. Further, also in the case where DI ratio correction amount |Δr| changes in accordance with the engine speed and load factor as shown in FIG. 11, it is necessary to prepare a map for use upon transition of operation mode reflecting the engine speed and load factor.

Similarly, other than the configuration where the arithmetic operation for correction (f+Δfp) concerning the total fuel injection quantity is performed in step S175 in FIG. 12, a map for use upon transition of operation mode concerning the total fuel injection quantity having Δfp added therein in advance may be prepared separately, and in step S175, the relevant map for use upon transition of operation mode may be referred to, instead of a normal total fuel injection quantity setting map. This configuration is more preferable from the standpoint of reduced operation load of engine ECU 300.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control apparatus of an internal combustion engine including first fuel injection means for injecting fuel into a cylinder and second fuel injection means for injecting fuel into an intake port and/or an intake manifold, comprising:

fuel injection control means for performing switching between a homogeneous combustion operation and a stratified charge combustion operation in accordance with an operation state and for controlling a fuel injection ratio of said first fuel injection means and a fuel injection ratio of said second fuel injection means with respect to a total fuel injection quantity required, wherein said fuel injection control means includes:

first fuel injection ratio setting means for setting said fuel injection ratios based on information correlated with the operation state of said internal combustion engine in said homogeneous combustion operation; and second fuel injection ratio setting means for setting said fuel injection ratios in place of said first fuel injection ratio setting means during a prescribed period from a switching time point from said stratified charge combustion operation to said homogeneous combustion operation, said second fuel injection ratio setting means includes means for increasing the fuel injection ratio of said second fuel injection means than the setting by said first fuel injection ratio setting means with respect to said information of the same content.

2. The control apparatus of an internal combustion engine according to claim 1, wherein an increase of the fuel injection ratio of said second fuel injection means by said second fuel injection ratio setting means is set in accordance with a period of said stratified charge combustion operation until the switching to said homogeneous combustion operation.

3. The control apparatus of an internal combustion engine according to claim 1, wherein a length of said prescribed period is set in accordance with a period of said stratified charge combustion operation until the switching to said homogeneous combustion operation.

4. The control apparatus of an internal combustion engine according to claim 1, wherein an increase of the fuel injection ratio of said second fuel injection means by said second fuel injection ratio setting means is set in accordance with an engine speed and a load factor of said internal combustion engine.

5. The control apparatus of an internal combustion engine according to claim 1, wherein said stratified charge combustion operation is carried out in a warm-up operation of a catalytic converter receiving exhaust gas from said internal combustion engine.

6. A control apparatus of an internal combustion engine including first fuel injection means for injecting fuel into a cylinder and second fuel injection means for injecting fuel into an intake port and/or an intake manifold, comprising:

fuel injection control means for performing switching between a homogeneous combustion operation and a stratified charge combustion operation in accordance with an operation state and for controlling a fuel injection ratio of said first fuel injection means and a fuel injection ratio of said second fuel injection means with respect to a total fuel injection quantity required, wherein said fuel injection control means includes:

first fuel injection ratio setting means for setting said fuel injection ratios based on information correlated with the operation state of said internal combustion engine in said homogeneous combustion operation; and fuel quantity decreasing means for decreasing said total fuel injection quantity by a prescribed quantity during a prescribed period from a switching time point from said stratified charge combustion operation to said homogeneous combustion operation when an operation region of said internal combustion engine at said switching time point falls within a region where the fuel injection ratio of said first fuel injection means is set to a prescribed first reference value or lower by said first fuel injection ratio setting means.

7. The control apparatus of an internal combustion engine according to claim 6, wherein said fuel injection control means further includes second fuel injection ratio setting means that is used in place of said first fuel injection ratio setting means during the prescribed period from the switching time point from said stratified charge combustion operation to said homogeneous combustion operation when the operation region of said internal combustion engine at said switching time point falls within a region where the fuel injection ratio of said first fuel injection means is set to a prescribed second reference value or higher by said first fuel injection ratio setting means, and said second fuel injection ratio setting means includes means for increasing the fuel injection ratio of said second fuel injection means than the setting by said first fuel injection ratio setting means with respect to said information of the same content.

8. The control apparatus of an internal combustion engine according to claim 6, wherein said stratified charge combustion operation is carried out in a warm-up operation of a catalytic converter receiving exhaust gas from said internal combustion engine.

9. A control apparatus of an internal combustion engine including a first fuel injection mechanism for injecting fuel into a cylinder and a second fuel injection mechanism for injecting fuel into an intake port and/or an intake manifold, comprising:

a fuel injection control portion configured to perform switching between a homogeneous combustion operation and a stratified charge combustion operation in accordance with an operation state and to control a fuel injection ratio of said first fuel injection mechanism and a fuel injection ratio of said second fuel injection mechanism with respect to a total fuel injection quantity required, wherein said fuel injection control portion includes:

a first fuel injection ratio setting portion configured to set said fuel injection ratios based on information correlated with the operation state of said internal combustion engine in said homogeneous combustion operation; and a second fuel injection ratio setting portion configured to set said fuel injection ratios in place of said first fuel injection ratio setting portion during a prescribed period from a switching time point from said stratified charge combustion operation to said homogeneous combustion operation, said second fuel injection ratio setting portion increases the fuel injection ratio of said second fuel injection mechanism than the setting by said first fuel injection ratio setting portion with respect to said information of the same content.

10. The control apparatus of an internal combustion engine according to claim 9, wherein an increase of the fuel injection ratio of said second fuel injection mechanism by said second fuel injection ratio setting portion is set in accordance with a period of said stratified charge combustion operation until the switching to said homogeneous combustion operation.

11. The control apparatus of an internal combustion engine according to claim 9, wherein a length of said prescribed period is set in accordance with a period of said stratified charge combustion operation until the switching to said homogeneous combustion operation.

12. The control apparatus of an internal combustion engine according to claim 9, wherein an increase of the fuel injection ratio of said second fuel injection mechanism by said second fuel injection ratio setting portion is set in accordance with an engine speed and a load factor of said internal combustion engine.

13. The control apparatus of an internal combustion engine according to claim 9, wherein said stratified charge combustion operation is carried out in a warm-up operation of a catalytic converter receiving exhaust gas from said internal combustion engine.

14. A control apparatus of an internal combustion engine including a first fuel injection mechanism for injecting fuel into a cylinder and a second fuel injection mechanism for injecting fuel into an intake port and/or an intake manifold, comprising:

a fuel injection control portion configured to perform switching between a homogeneous combustion operation and a stratified charge combustion operation in accordance with an operation state and to control a fuel injection ratio of said first fuel injection mechanism and a fuel injection ratio of said second fuel injection mechanism with respect to a total fuel injection quantity required, wherein said fuel injection control portion includes:

a first fuel injection ratio setting portion configured to set said fuel injection ratios based on information correlated with the operation state of said internal combustion engine in said homogeneous combustion operation; and a fuel quantity decreasing portion configured to decrease said total fuel injection quantity by a prescribed quantity during a prescribed period from a switching time point from said stratified charge combustion operation to said homogeneous combustion operation when an operation region of said internal combustion engine at said switching time point falls within a region where the fuel injection ratio of said first fuel injection mechanism is set to a prescribed first reference value or lower by said first fuel injection ratio setting portion.

15. The control apparatus of an internal combustion engine according to claim 14, wherein said fuel injection control portion further includes a second fuel injection ratio setting portion that is used in place of said first fuel injection ratio setting portion during the prescribed period from the switching time point from said stratified charge combustion operation to said homogeneous combustion operation when the operation region of said internal combustion engine at said switching time point falls within a region where the fuel injection ratio of said first fuel injection mechanism is set to a prescribed second reference value or higher by said first fuel injection ratio setting portion, and said second fuel injection ratio setting portion increases the fuel injection ratio of said second fuel injection mechanism than the setting by said first fuel injection ratio setting portion with respect to said information of the same content.

16. The control apparatus of an internal combustion engine according to claim 14, wherein said stratified charge combustion operation is carried out in a warm-up operation of a catalytic converter receiving exhaust gas from said internal combustion engine.

* * * * *